US009142892B2

(12) United States Patent
Liu et al.

(10) Patent No.: US 9,142,892 B2
(45) **Date of Patent: *Sep. 22, 2015**

(54) METAMATERIAL AND METAMATERIAL ANTENNA

(75) Inventors: Ruopeng Liu, Guangdong (CN); Chunlin Ji, Guangdong (CN); Yutao Yue, Guangdong (CN)

(73) Assignees: KUANG-CHI INNOVATIVE TECHNOLOGY LTD., FuTian District, Shenzhen Guangdong; KUANG-CHI INSTITUTE OF ADVANCED TECHNOLOGY, High-Tech Industrial Estate, Nanshan District, Shenzhen, Guangdong ( * ) Notice: Subject to any disclaimer, the term of this patent is extended or adjusted under 35 U.S.C. 154(b) by 517 days.

This patent is subject to a terminal disclaimer.

(21) Appl. No.: 13/522,969

(22) PCT Filed: Nov. 16, 2011

(86) PCT No.: PCT/CN2011/082310

§ 371 (c)(1), (2), (4) Date: Jul. 19, 2012

(87) PCT Pub. No.: WO2013/000233

PCT Pub. Date: Jan. 3, 2013

(65) Prior Publication Data

US 2013/0002500 A1 Jan. 3, 2013

(51) Int. Cl.
*H01Q 19/06* (2006.01)
*H01Q 15/08* (2006.01)

(52) U.S. Cl.
CPC ..... *H01Q 15/08* (2013.01); *H01Q 19/06* (2013.01)

(58) Field of Classification Search
CPC ..... H01Q 15/02; H01Q 19/65
USPC ..... 343/753, 909, 757, 761, 782; 375/338; 250/339.05, 482.1, 503.1; 359/642, 359/620, 321, 341.32, 586, 652
See application file for complete search history.

(56) References Cited

U.S. PATENT DOCUMENTS 5,661,499 A * 8/1997 Epshtein et al. ..... 343/911 R
6,151,168 A * 11/2000 Goering et al. ..... 359/623
2011/0199281 A1* 8/2011 Morton et al. ..... 343/872

* cited by examiner

*Primary Examiner* — Sue A Purvis
*Assistant Examiner* — Jae Kim
(74) *Attorney, Agent, or Firm* — Winston Hsu; Scott Margo

(57) ABSTRACT

The present invention relates to a metamaterial and a metamaterial antenna. The metamaterial is disposed in a propagation direction of the electromagnetic waves emitted from a radiation source. A line connecting the radiation source to a point on a first surface of the metamaterial and a line perpendicular to the metamaterial form an angle θ therebetween, which uniquely corresponds to a curved surface in the metamaterial. Each point on the curved surface to which the angle θ uniquely corresponds has a same refractive index. Refractive indices of the metamaterial decrease gradually as the angle θ increases. The electromagnetic waves propagating through the metamaterial exits in parallel from a second surface of the metamaterial. The refraction, diffraction and reflection at the abrupt transition points can be significantly reduced in the present disclosure and the problems caused by interferences are eased, which further improves performances of the metamaterial and the metamaterial antenna.

20 Claims, 9 Drawing Sheets

METAMATERIAL AND METAMATERIAL ANTENNA

FIELD OF THE INVENTION

The present invention generally relates to the field of electromagnetic technologies, and more particularly, to a metamaterial and a metamaterial antenna.

BACKGROUND OF THE INVENTION

In conventional optics, a lens can be used to refract a spherical wave, which is radiated from a point light source located at a focus of the lens, into a plane wave. Currently, the converging effect of the lens is achieved by virtue of the refractive property of the spherical shape of the lens. As shown in FIG. 1, a spherical wave emitted from a radiator 30 is converged by a spherical lens 40 and exits in the form of a plane wave. The inventor has found in the process of making this invention that, the lens antenna has at least the following technical problems: the spherical lens 40 is bulky and heavy, which is unfavorable for miniaturization; performances of the spherical lens 40 rely heavily on the shape thereof, and directional propagation from the antenna can be achieved only when the spherical lens 40 has a precise shape; and serious interferences and losses are caused to the electromagnetic waves, which reduces the electromagnetic energy. Moreover, for most lenses, abrupt transitions of the refractive indices follow a simple line that is perpendicular to a lens surface. Consequently, electromagnetic waves propagating through the lenses suffer from considerable refraction, diffraction and reflection, which have a serious effect on the performances of the lenses.

SUMMARY OF THE INVENTION

In view of the aforesaid problems that the prior art suffers from considerable refraction, diffraction and reflection and has poor metamaterial performances, an objective of the present invention is to provide a metamaterial and a metamaterial antenna that have superior performances.

To achieve the aforesaid objective, the present invention provides a metamaterial. A line connecting a radiation source to a point on a first surface of the metamaterial and a line perpendicular to the metamaterial form an angle θ therebetween, which uniquely corresponds to a curved surface in the metamaterial. Each point on the curved surface to which the angle θ uniquely corresponds has a same refractive index. Refractive indices of the metamaterial decrease gradually as the angle θ increases. Electromagnetic waves propagating through the metamaterial exits in parallel from a second surface of the metamaterial.

Preferably, the refractive index distribution of the curved surface satisfies:

$$n(\theta) = \frac{1}{S(\theta)}\left[F\left(1 - \frac{1}{\cos\theta}\right) + n_{max}d\right];$$

where, S(θ) is an arc length of a generatrix of the curved surface, F is a distance from the radiation source to the metamaterial; d is a thickness of the metamaterial; and $n_{max}$ is the maximum refractive index of the metamaterial.

Preferably, the metamaterial comprises at least one metamaterial sheet layer, each of which comprises a sheet-like substrate and a plurality of man-made microstructures attached on the substrate.

Preferably, each of the man-made microstructures is a two-dimensional (2D) or three-dimensional (3D) structure consisting of at least one metal wire and having a geometric pattern.

Preferably, each of the man-made microstructures is of an "I" shape, a "cross" shape or a snowflake shape.

Preferably, when the generatrix of the curved surface is a parabolic arc, the arc length S(θ) of the parabolic arc satisfies:

$$S(\theta) = \frac{d}{2}\left[\frac{\log\left(|\tan\theta| + \sqrt{1+\tan^2\theta}\right) + \delta}{|\tan\theta| + \delta} + \sqrt{1+\tan^2\theta}\right];$$

where δ is a preset decimal.

Preferably, when a line passing through a center of the first surface of the metamaterial and perpendicular to the metamaterial is taken as an abscissa axis and a line passing through the center of the first surface of the metamaterial and parallel to the first surface is taken as an ordinate axis, an equation of a parabola where the parabolic arc is located is represented as:

$$y(x) = \tan\theta\left(-\frac{1}{2d}x^2 + x + F\right).$$

Preferably, the angle θ and each point (x, y) of the parabolic arc satisfy the following relational expression:

$$\theta(x, y) = \tan^{-1}\left[\frac{2dy}{2d(F+x) - x^2}\right].$$

Preferably, when the generatrix of the curved surface is an elliptical arc, the line passing through the center of the first surface of the metamaterial and perpendicular to the metamaterial is taken as an abscissa axis and the line passing through the center of the first surface of the metamaterial and parallel to the first surface is taken as an ordinate axis, an equation of an ellipse where the elliptical arc is located is represented as:

$$\frac{(x-d)^2}{a^2} + \frac{(y-c)^2}{b^2} = 1;$$

where a, b and c satisfy the following relationships:

$$\frac{d^2}{a^2} + \frac{(F\tan\theta - c)^2}{b^2} = 1;$$

$$\frac{\sin\theta}{\sqrt{n^2(\theta) - \sin^2(\theta)}} = \frac{b^2}{a^2}\frac{d}{F\tan\theta - c}.$$

Preferably, a center of the ellipse where the elliptical arc is located is located on the second surface and has coordinates (d, c).

Preferably, a point on the first surface corresponding to the angle θ has a refraction angle θ', and a refractive index n(θ) of the point satisfies:

$$n(\theta) = \frac{\sin\theta}{\sin\theta'}.$$

Preferably, when the generatrix of the curved surface is a circular arc, the refractive index distribution of the curved surface satisfies:

$$n(\theta) = \frac{\sin\theta}{d \times \theta}\left(n_{max} \times d + s - \frac{s}{\cos\theta}\right);$$

where, s is a distance from the radiation source to the metamaterial; d is a thickness of the metamaterial; and $n_{max}$ is the maximum refractive index of the metamaterial.

Preferably, a perpendicular line of a line connecting the radiation source to a point on the first surface of the metamaterial intersects with the second surface of the metamaterial at a circle center of the circular arc, and a perpendicular line segment between the circle center and a point on the first surface of the metamaterial is a radius of the circular arc.

Preferably, the metamaterial is provided with an impedance matching layer at two sides thereof respectively.

To achieve the aforesaid objective, the present invention further provides a metamaterial antenna, which comprises a metamaterial and a radiation source disposed at a focus of the metamaterial. A line connecting the radiation source to a point on a first surface of the metamaterial and a line perpendicular to the metamaterial form an angle θ therebetween, which uniquely corresponds to a curved surface in the metamaterial. Each point on the curved surface to which the angle θ uniquely corresponds has a same refractive index. Refractive indices of the metamaterial decrease gradually as the angle θ increases. Electromagnetic waves propagating through the metamaterial exits in parallel from a second surface of the metamaterial.

Preferably, the refractive index distribution of the curved surface satisfies:

$$n(\theta) = \frac{1}{S(\theta)}\left[F\left(1 - \frac{1}{\cos\theta}\right) + n_{max}d\right];$$

where, S(θ) is an arc length of the parabolic, F is a distance from the radiation source to the metamaterial; d is a thickness of the metamaterial; and $n_{max}$ is the maximum refractive index of the metamaterial.

Preferably, the metamaterial comprises at least one metamaterial sheet layer, each of which comprises a sheet-like substrate and a plurality of man-made microstructures attached on the substrate.

Preferably, when the generatrix of the curved surface is an elliptical arc, a line passing through a center of the first surface of the metamaterial and perpendicular to the metamaterial is taken as an abscissa axis and a line passing through the center of the first surface of the metamaterial and parallel to the first surface is taken as an ordinate axis, an equation of an ellipse where the elliptical arc is located is represented as:

$$\frac{(x-d)^2}{a^2} + \frac{(y-c)^2}{b^2} = 1;$$

where a, b and c satisfy the following relationships:

$$\frac{d^2}{a^2} + \frac{(F\tan\theta - c)^2}{b^2} = 1;$$

$$\frac{\sin\theta}{\sqrt{n^2(\theta) - \sin^2(\theta)}} = \frac{b^2}{a^2}\frac{d}{F\tan\theta - c}.$$

Preferably, when the generatrix of the curved surface is a parabolic arc, the arc length S(θ) of the parabolic arc satisfies:

$$S(\theta) = \frac{d}{2}\left[\frac{\log\left(|\tan\theta| + \sqrt{1+\tan^2\theta}\right) + \delta}{|\tan\theta| + \delta} + \sqrt{1+\tan^2\theta}\right];$$

where δ is a preset decimal.

Preferably, when the line passing through the center of the first surface of the metamaterial and perpendicular to the metamaterial is taken as an abscissa axis and the line passing through the center of the first surface of the metamaterial and parallel to the first surface is taken as an ordinate axis, an equation of a parabola where the parabolic arc is located is represented as:

$$y(x) = \tan\theta\left(-\frac{1}{2d}x^2 + x + F\right).$$

The technical solutions of the present invention have the following benefits: by designing abrupt transitions of the refractive indices of the metamaterial to follow a curved surface, the refraction, diffraction and reflection at the abrupt transition points can be significantly reduced. As a result, the problems caused by interferences are eased, which further improves performances of the metamaterial and the metamaterial antenna.

BRIEF DESCRIPTION OF THE DRAWINGS

Hereinbelow, the present invention will be further described with reference to the attached drawings and embodiments thereof. In the attached drawings.

DETAILED DESCRIPTION OF THE INVENTION

Figure 1:
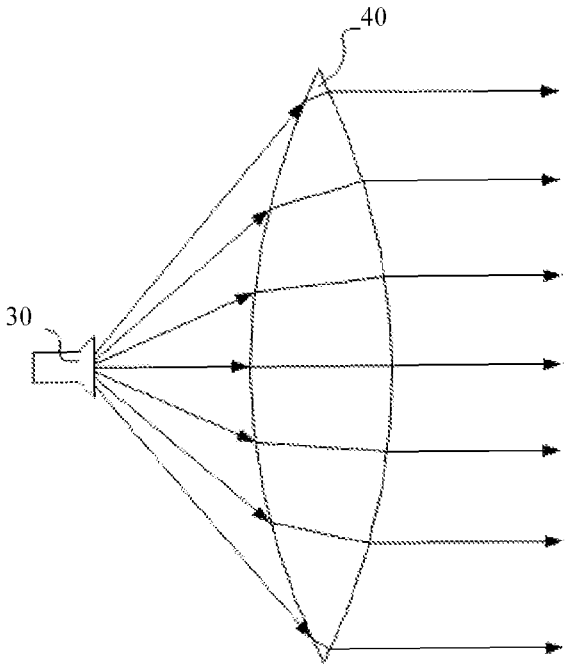
FIG. 1 is a schematic view illustrating a conventional spherical lens which is converging electromagnetic waves.
Figure 2:
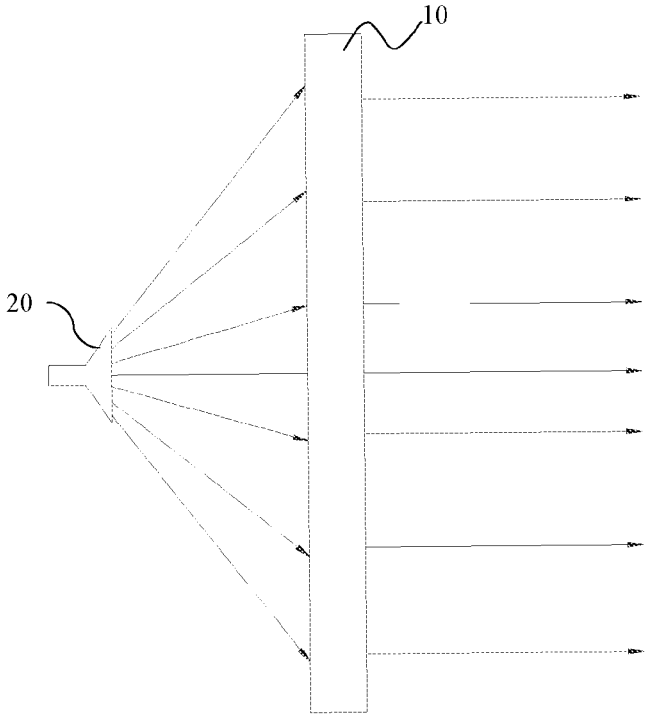
FIG. 2 is a schematic view illustrating a metamaterial according to an embodiment of the present invention which is converging electromagnetic waves.

FIG. 2 is a schematic view illustrating a metamaterial according to an embodiment of the present invention which is converging electromagnetic waves. The metamaterial 10 is disposed in a propagation direction of electromagnetic waves emitted from a radiation source.

As can be known as a common sense, the refractive index of the electromagnetic wave is proportional to $\sqrt{\epsilon \times \mu}$. When an electromagnetic wave propagates from a medium to another medium, the electromagnetic wave will be refracted; and if the refractive index distribution in the material is non-uniform, then the electromagnetic wave will be deflected towards a site having a larger refractive index. By designing electromagnetic parameters of the metamaterial at each point, the refractive index distribution of the metamaterial can be adjusted so as to achieve the purpose of changing the propagating path of the electromagnetic wave. According to the aforesaid principle, the refractive index distribution of the metamaterial 10 can be designed in such a way that an electromagnetic wave diverging in the form of a spherical wave that is emitted from the radiation source 20 is converted into a plane electromagnetic wave suitable for long-distance transmission.

Figure 3:
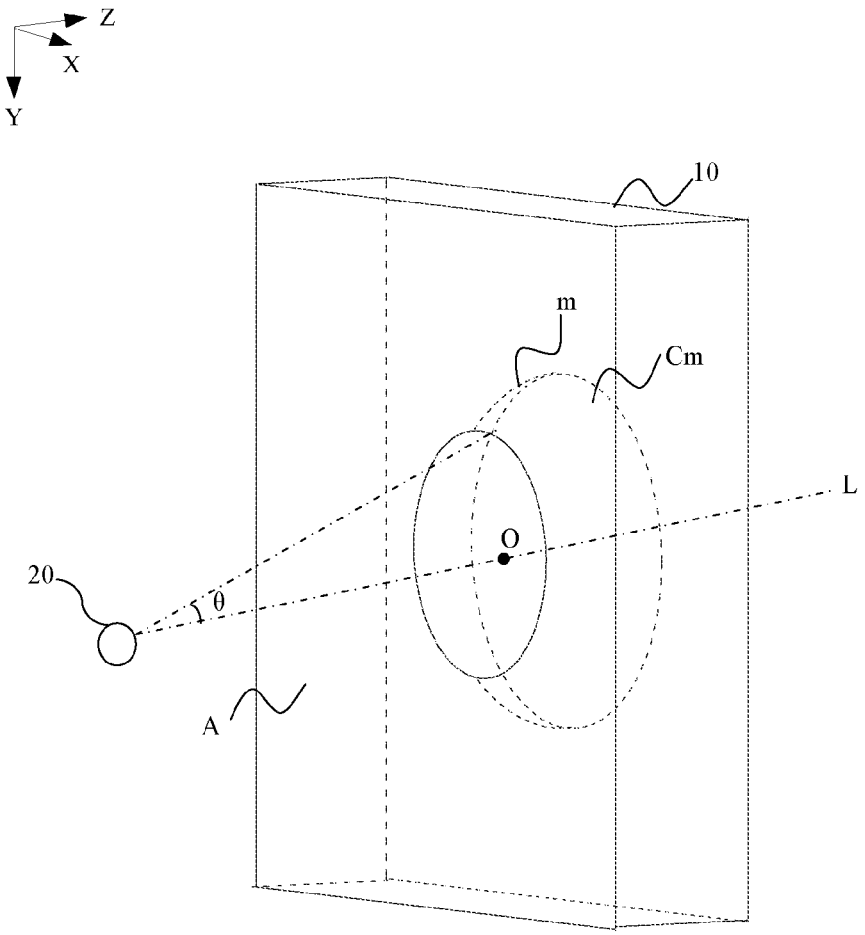
FIG. 3 is a schematic view illustrating a shape of a curved surface in the metamaterial 10 shown in FIG. 2 to which an angle θ uniquely corresponds.

FIG. 3 is a schematic view illustrating a shape of a curved surface in the metamaterial 10 shown in FIG. 2 to which an angle θ uniquely corresponds. As shown, a line connecting the radiation source 20 to a point on a first surface A of the metamaterial 10 and a line L passing through a center O of the first surface A of the metamaterial 10 and perpendicular to the metamaterial 10 form an angle θ therebetween, which uniquely corresponds to a curved surface Cm in the metamaterial 10. Each point on the curved surface Cm to which the angle θ uniquely corresponds has a same refractive index. Refractive indices of the metamaterial 10 decrease gradually as the angle θ increases. The electromagnetic waves propagating through the metamaterial exits in parallel from a second surface B of the metamaterial.

Figure 4:
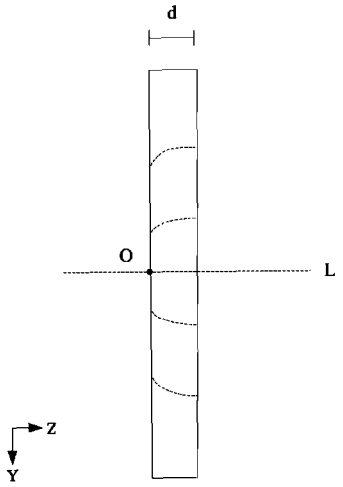
FIG. 4 is a side view of the metamaterial 10 shown in FIG. 3.

As shown in FIG. 3, a generatrix of the curved surface Cm is an arc m, and the curved surface Cm is obtained through rotation of the arc m about the line L. FIG. 4 is a side view of the metamaterial 10. The thickness of the metamaterial 10 is as shown by d, and L represents a line perpendicular to the metamaterial. A side cross-sectional view of a curved surface having a same refractive index is in the form of two arcs, which are symmetrical with respect to the line L. The arc shown by a dashed line is a generatrix of a virtual curved surface in the metamaterial 10. In order to describe more clearly that points on the same curved surface have the same refractive index, the virtual curved surface (which does not exist actually, and is elucidated only for convenience of description) in the metamaterial will also be elucidated.

Figure 5:
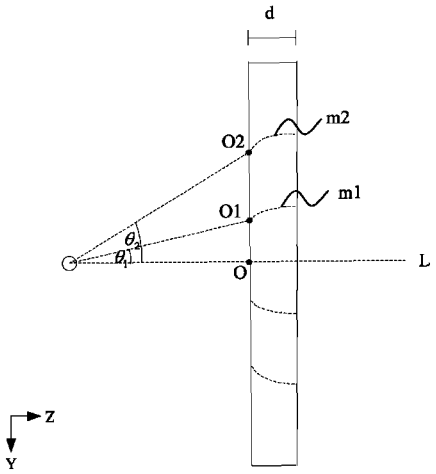
FIG. 5 is a schematic view illustrating a generatrix m of the curved surface Cm shown in FIG. 3 when being a parabolic arc.

FIG. 5 is a schematic view illustrating the generatrix m of the curved surface Cm shown in FIG. 3 when being a parabolic arc. As shown, a line connecting the radiation source to a point O1 on the first surface of the metamaterial and the line L passing through the center O of the first surface and perpendicular to the metamaterial 10 form an angle $\theta_1$ therebetween, which corresponds to a parabolic arc m1; and each point on a virtual curved surface which is obtained through rotation of the parabolic arc m1 has a same refractive index. Likewise, a line connecting the radiation source to a point O2 on the first surface of the metamaterial and the line L form an angle $\theta_2$ therebetween, which corresponds to a parabolic arc m2; and each point on a virtual curved surface which is obtained through rotation of the parabolic arc m2 has a same refractive index.

The refractive index distribution of the virtual curved surface satisfies:

$$n(\theta) = \frac{1}{S(\theta)}\left[F\left(1 - \frac{1}{\cos\theta}\right) + n_{max}d\right].$$

Figure 6:
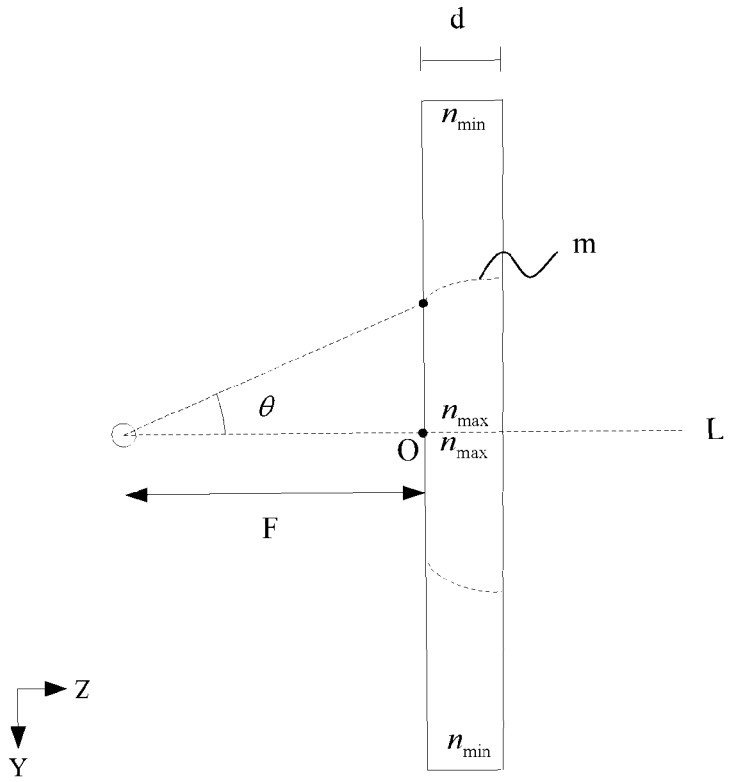
FIG. 6 is a schematic view illustrating variations of refractive indices of FIG. 5.

As shown in FIG. 6, S(θ) is an arc length of the generatrix (the parabolic arc m) of the virtual curved surface, F is a distance from the radiation source 20 to the metamaterial 10; d is a thickness of the metamaterial 10: and $n_{max}$ is the maximum refractive index of the metamaterial.

The arc length S(θ) of the parabolic arc satisfies:

$$S(\theta) = \int_0^d ds = \int_0^d \sqrt{1 + \tan^2\theta \frac{x^2}{d^2}}\, dx = \frac{d}{2}\left[\frac{\log\left(|\tan\theta| + \sqrt{1 + \tan^2\theta}\right) + \delta}{|\tan\theta| + \delta} + \sqrt{1 + \tan^2\theta}\right],$$

where δ is a preset decimal (e.g., 0.0001), and can ensure that the ratio $$\frac{\log\left(|\tan\theta| + \sqrt{1 + \tan^2\theta}\right) + \delta}{|\tan\theta| + \delta}$$

converges when the angle θ approaches to 0.

Figure 7:
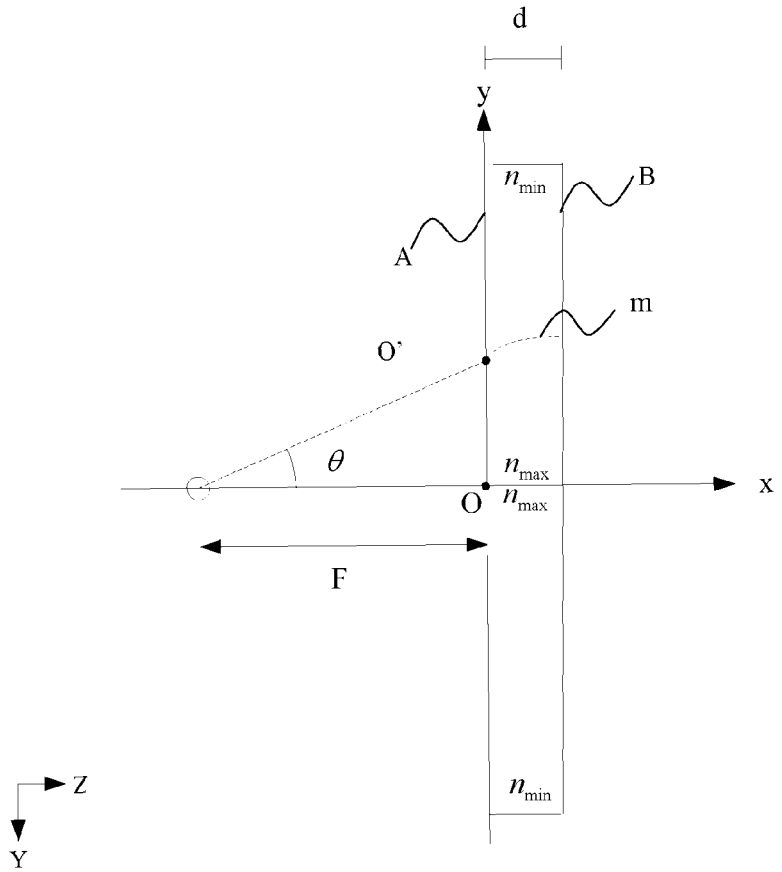
FIG. 7 is a schematic view illustrating coordinates of the parabolic arc of FIG. 5.

As shown in FIG. 7, when the line L passing through the center of the first surface of the metamaterial 10 and perpendicular to the metamaterial 10 is taken as an abscissa axis and a line passing through the center O of the first surface of the metamaterial 10 and parallel to the first surface is taken as an ordinate axis, a line connecting the radiation source to a certain point O' on the surface A and the X axis form an angle θ therebetween. The angle θ and each point (x, y) of the parabolic arc m satisfy the following relational expression:

$$\theta(x, y) = \tan^{-1}\left[\frac{2dy}{2d(F + x) - x^2}\right].$$

Suppose that an equation of a parabola where the parabolic arc m is located is: $y(x)=ax^2+bx+c$. The parabola passes through a point (0, F tan θ); i.e., y(0)=c=F tan θ. In order to make the electromagnetic wave exit in parallel after passing though the metamaterial, a tangent line of the parabolic arc must be parallel with the X axis when the electromagnetic wave propagates through the second surface B of the metamaterial; i.e., it must be ensured that y'(d)=0. Because y'(x) =2ax+b, y'(d)=2ad+b=0. In addition, it must also be ensured that the electromagnetic wave propagates in a tangent direction corresponding to the angle θ when reaching the first surface A of the metamaterial, so y'(0)=tan θ. It can be derived from the aforesaid conditions that the equation of the parabola is $$y(x) = \tan\theta\left(-\frac{1}{2d}x^2 + x + F\right).$$

Thereby, a relational expression between the angle θ and each point (x, y) on the parabolic arc m can be obtained as $$\theta(x, y) = \tan^{-1}\left[\frac{2dy}{2d(F+x) - x^2}\right].$$

The angle θ uniquely corresponds to a curved surface in the metamaterial, which is obtained through rotation of the generatrix m about the line L (the X axis); and each point on the curved surface to which the angle θ uniquely corresponds has a same refractive index.

The metamaterial can be used to convert the electromagnetic wave emitted from the radiation source into a plane wave. Refractive indices of the metamaterial decrease from $n_{max}$ to $n_{min}$ as the angle θ increases, as shown in FIG. 7. An arc shown by a dashed line is a generatrix of a virtual curved surface in the metamaterial, and refractive indices on a same curved surface are identical to each other. It shall be appreciated that, the metamaterial of the present invention may also be used to converge a plane wave to a focus (i.e., a case reversed from what is shown in FIG. 2). In this case, there is no need to change the construction of the metamaterial so long as the radiation source is placed at a side of the second surface B; and the principle is the same except that the radiation source in the definition of the angle θ shall be located at the side of the first surface A and located at a position of the virtual radiation source corresponding to the focus of the metamaterial. Various applications adopting the principle of the present invention shall all fall within the scope of the present invention.

The metamaterial has a plurality of man-made microstructures disposed therein, which make the refractive indices of the metamaterial decrease gradually as the angle θ increases. The plurality of man-made microstructures are of a same geometric form, and decrease in size gradually as the angle θ increases.

Figure 8:
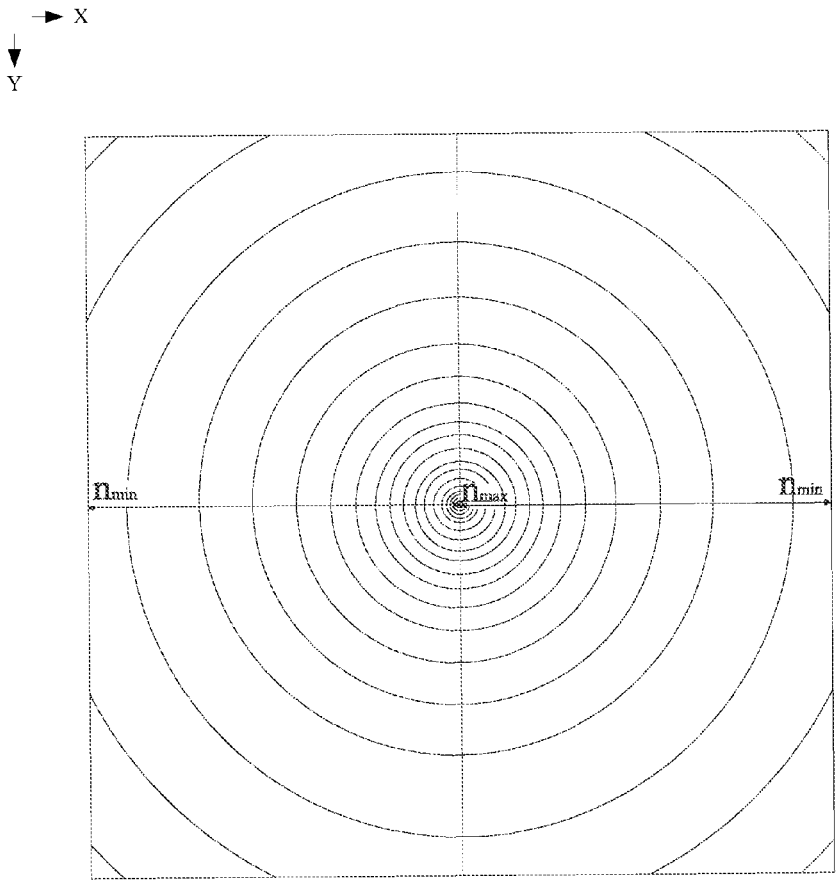
FIG. 8 is a diagram illustrating the refractive index distribution of the metamaterial of FIG. 5 in a yx plane.

In order to more intuitively represent the refractive index distribution of each metamaterial sheet layer in a YX plane, the units that have the same refractive index are connected to form a line, and the magnitude of the refractive index is represented by the density of the lines. A higher density of the lines represents a larger refractive index. The refractive index distribution of the metamaterial satisfying all of the above relational expressions is as shown in FIG. 8.

The generatrix of the curved surface Cm may also be of some other curved shapes, for example but is not limited to, an elliptical arc. Hereinbelow, a case in which the generatrix of the curved surface Cm is an elliptical arc will be elucidated as an example.

The generatrix of the curved surface Cm as shown in FIG. 3 is an elliptical arc m, and the curved surface Cm is obtained through rotation of the elliptical arc in about the line L. A side cross-sectional view of a curved surface having a same refractive index is in the form of two elliptical arcs, which are symmetrical with respect to the line L. The elliptical arc shown by a dashed line is a generatrix of a virtual curved surface in the metamaterial 10. In order to describe more clearly that points on the same curved surface have the same refractive index, the virtual curved surface (which does not exist actually, and is elucidated only for convenience of description) in the metamaterial will also be elucidated. For the elliptical arc, as shown in FIG. 5, a line connecting the radiation source to a point O1 on the first surface of the metamaterial and the line L passing through the center O of the first surface and perpendicular to the metamaterial 10 form an angle $\theta_1$ therebetween, which corresponds to an elliptical arc m1; and each point on a virtual curved surface which is obtained through rotation of the elliptical arc m1 has a same refractive index. Likewise, a line connecting the radiation source to a point O2 on the first surface of the metamaterial and the line L form an angle $\theta_2$ therebetween, which corresponds to an elliptical arc m2; and each point on a virtual curved surface which is obtained through rotation of the elliptical arc m2 has a same refractive index.

The refractive index distribution of the virtual curved surface satisfies:

$$n(\theta) = \frac{1}{S(\theta)}\left[F\left(1 - \frac{1}{\cos\theta}\right) + n_{max}d\right].$$

As shown in FIG. 6, S(θ) is an arc length of the generatrix (the elliptical arc m) of the virtual curved surface, F is a distance from the radiation source 20 to the metamaterial 10; d is a thickness of the metamaterial 10; and $n_{max}$ is the maximum refractive index of the metamaterial.

Figure 9:
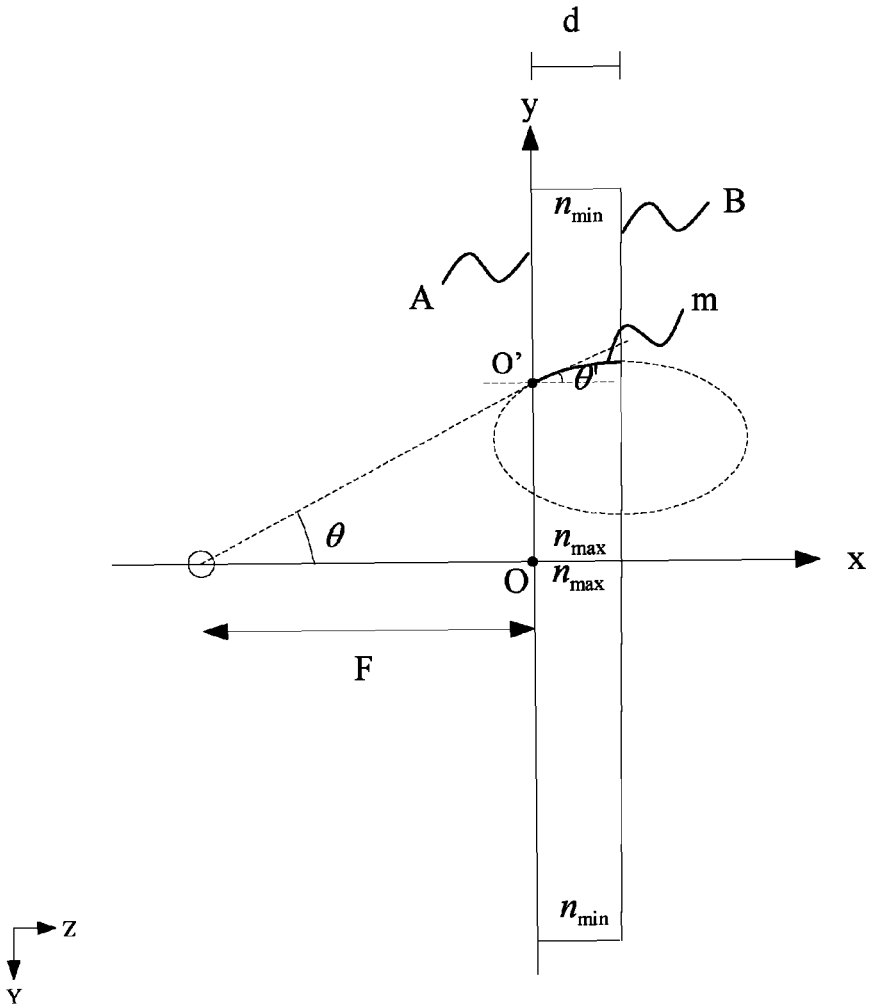
FIG. 9 is a schematic view illustrating the generatrix m of the curved surface Cm shown in FIG. 3 when being an elliptical arc.

As shown in FIG. 9, when the line L passing through the center O of the first surface of the metamaterial 10 and perpendicular to the metamaterial 10 is taken as an abscissa axis and the line passing through the center O of the first surface of the metamaterial 10 and parallel to the first surface is taken as an ordinate axis, a line connecting the radiation source to a point O' on the surface A and the X axis form an angle θ therebetween. An equation of an ellipse where the elliptical arc m shown by a solid line on the ellipse is located is:

$$\frac{(x-d)^2}{a^2} + \frac{(y-c)^2}{b^2} = 1.$$

A center of the ellipse is located on the second surface B, and has coordinates (d, c). The ellipse passes through a point (0, F tan θ); i.e., y(0)=F tan θ. Through the equation of the ellipse, it can be obtained that $$\frac{d^2}{a^2} + \frac{(F\tan\theta - c)^2}{b^2} = 1.$$

In order to make the electromagnetic wave exit in parallel after passing through the metamaterial, a tangent line of the parabolic arc must be parallel with the X axis when the electromagnetic wave propagates through the second surface B of the metamaterial; i.e., it must be ensured that y'(d)=0. A tangential equation at any point (x, y) on the ellipse is $$\frac{dy}{dx} = -\frac{b^2}{a^2}\frac{x-d}{y-c},$$

so it can be obtained that y'(d)=0.

The point O' on the first surface A corresponding to the angle θ has a refraction angle θ' and a refractive index n(θ); and it can be known from the Snell's law that $$n(\theta) = \frac{\sin\theta}{\sin\theta'}.$$

The electromagnetic wave propagates in a tangent direction corresponding to the refraction angle θ' when reaching the first surface A of the metamaterial 10 (as shown in FIG. 9). That is, at a point where the elliptical arc m infinitely approaches to the point O', $y'(0^+)=\tan\theta'$. Thereby, the following relational expression can be obtained:

$$y'(0^+) = \tan\theta' = \frac{\sin\theta}{\sqrt{n^2(\theta) - \sin^2(\theta)}} = \frac{b^2}{a^2}\frac{d}{F\tan\theta - c}.$$

The angle θ uniquely corresponds to a curved surface in the metamaterial, which is obtained through rotation of the generatrix m about the line L (the X axis): and each point on the curved surface to which the angle θ uniquely corresponds has a same refractive index. The angle θ ranges between $$[0, \frac{\pi}{2}).$$

It shall be appreciated that, when a=b in the ellipse, the ellipse becomes a true circle; and in this case, the corresponding elliptical arc becomes a circular arc, and the curved surface is formed through rotation of the circular arc about the line L (the X axis).

Figure 10:
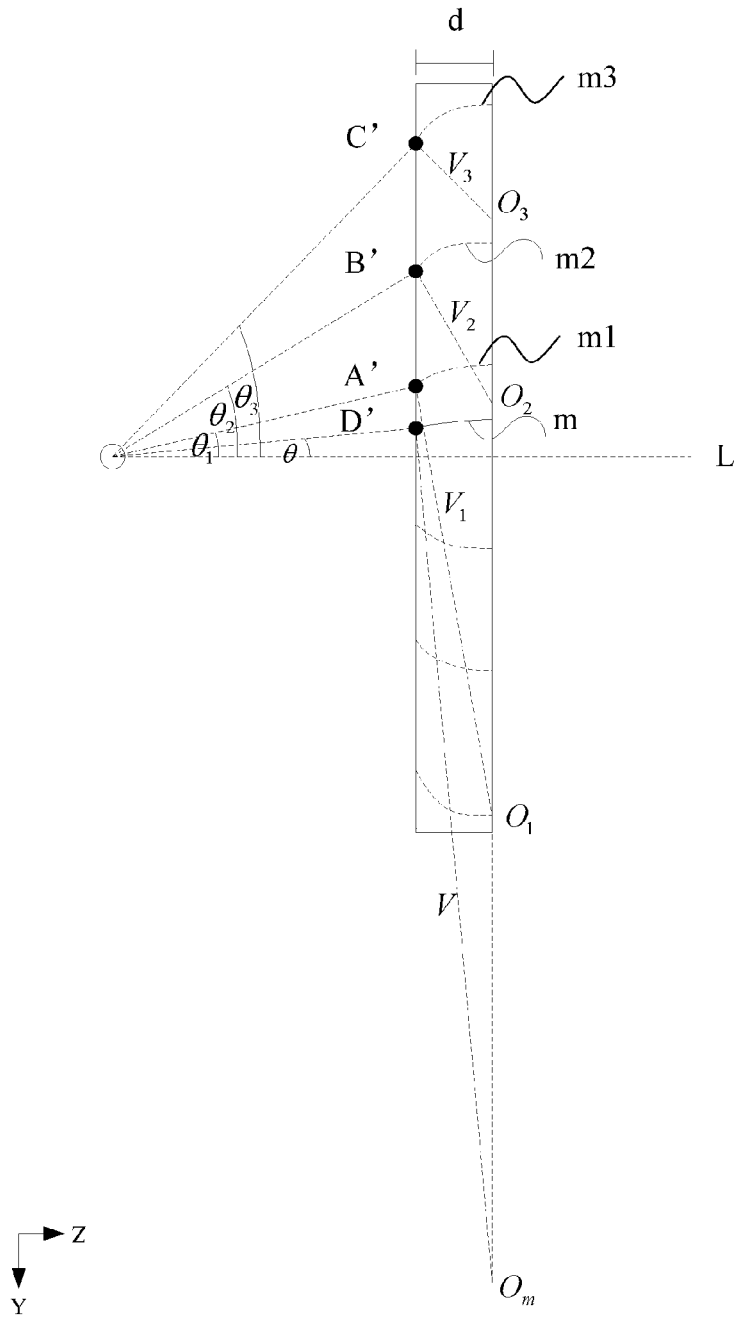
FIG. 10 is a schematic view illustrating the construction of the generatrix m of the curved surface Cm shown in FIG. 3 when the generatrix m is a circular arc.

When the generatrix of the curved surface is a circular arc, the arc shown in FIG. 4 is a circular arc, and a schematic view of the construction of the circular arc is shown in FIG. 10. The circular arcs shown by dashed lines in FIG. 10 are generatrices of curved surfaces in the metamaterial. In order to describe more clearly that points on the same curved surface have the same refractive index, the virtual curved surface (which does not exist actually, and is elucidated only for convenience of description) in the metamaterial will also be elucidated. A perpendicular line of a line connecting the radiation source to a point on the first surface A of the metamaterial intersects with the second surface B of the metamaterial 10 at a circle center of the circular arc, and a perpendicular line segment between the circle center and a point on the first surface A of the metamaterial is a radius of the circular arc. The metamaterial has the maximum refractive index at the center thereof.

A line connecting the radiation source to a point C' on the first surface A of the metamaterial and the line L form an angle θ, therebetween, a perpendicular line segment $V_3$ of the line connecting the radiation source to the point C' intersects with the other surface of the metamaterial at a point $O_3$, and the corresponding curved surface in the metamaterial has a generatrix m3, which is a circular arc obtained through rotation about the point $O_3$ with the perpendicular line segment $V_3$ as a radius. In order to describe more clearly that points on the same curved surface have the same refractive index, the virtual curved surface in the metamaterial will also be elucidated. FIG. 10 illustrates circular arcs m1, m2 which are generatrices of two virtual curved surfaces in the metamaterial. The circular arc m1 corresponds to an angle $\theta_1$ and a point A' on the first surface of the metamaterial. A perpendicular line segment $V_1$ of a line connecting the radiation source to the point A' intersects with the other surface of the metamaterial 10 at a point $O_1$, and an outer surface of the virtual curved surface has a generatrix m1, which is a circular arc obtained through rotation about the point $O_1$ with the perpendicular line segment $V_1$ as a radius. Likewise, the circular arc m2 corresponds to an angle $\theta_2$ and a point B' on the first surface. A perpendicular line segment $V_2$ of a line connecting the radiation source to the point B' intersects with the second surface B of the metamaterial 10 at a point $O_2$, and an outer surface of the virtual curved surface has a generatrix m2, which is a circular arc obtained through rotation about the point $O_2$ with the perpendicular line segment $V_1$ as a radius. As shown in FIG. 5, the circular arcs m1, m2, m3 are distributed symmetrically with respect to the line L.

For any point D' on the first surface A, a line connecting the radiation source to the point D' on the first surface A and the line perpendicular to the metamaterial 10 form an angle θ therebetween, which ranges between $$[0, \frac{\pi}{2}).$$

The rule of the refractive index n(θ) of the metamaterial varying with the angle θ satisfies:

$$n(\theta) = \frac{\sin\theta}{d \times \theta}\left(n_{max} \times d + s - \frac{s}{\cos\theta}\right),$$

where, s is a distance from the radiation source to the metamaterial 10; d is a thickness of the metamaterial 10; and $n_{max}$ is the maximum refractive index of the metamaterial. The angle θ uniquely corresponds to a curved surface in the metamaterial, and each point on the curved surface to which the angle θ uniquely corresponds has a same refractive index.

As shown in FIG. 10, a line connecting the radiation source to a certain point on the first surface A and the line perpendicular to the metamaterial 10 form an angle θ therebetween, a perpendicular line segment V of the line connecting the radiation source to the point on the first surface A intersects with the second surface B of the metamaterial at a point $O_m$, and a generatrix m is a circular arc obtained through rotation about the point $O_m$ with the perpendicular line segment V as a radius. The angle θ uniquely corresponds to a curved surface in the metamaterial, which is obtained through rotation of the generatrix m about the line L; and each point on the curved surface to which the angle θ uniquely corresponds has a same refractive index.

The metamaterial can be used to convert the electromagnetic wave emitted from the radiation source into a plane wave. Refractive indices of the metamaterial decrease from $n_{max}$ to $n_{min}$ as the angle increases.

The metamaterial can be used to convert the electromagnetic wave emitted from the radiation source into a plane wave. Refractive indices of the metamaterial decrease from $n_{max}$ to $n_{min}$ as the angle θ increases, as shown in FIG. 10. The elliptical arc shown by a solid line on the ellipse is a generatrix of a virtual curved surface in the metamaterial, and each point on the same curved surface has a same refractive index. It shall be appreciated that, the metamaterial of the present invention may also be used to converge a plane wave to a focus (i.e., a case reversed from what is shown in FIG. 2). In this case, there is no need to change the construction of the metamaterial so long as the radiation source is placed at a side of the second surface B; and the principle is the same except that the radiation source in the definition of the angle θ shall be located at the side of the first surface A and located at a position of the virtual radiation source corresponding to the focus of the metamaterial. Various applications adopting the principle of the present invention shall all fall within the scope of the present invention.

In practical structure designs, the metamaterial may be designed to be formed by a plurality of metamaterial sheet layers, each of which comprises a sheet-like substrate and a plurality of man-made microstructures or man-made pore structures attached on the substrate. The overall refractive index distribution of the plurality of metamaterial sheet layers combined together must satisfy or approximately satisfy the aforesaid equations so that refractive indices on a same curved surface are identical to each other, and the generatrix of the curved surface is designed as an elliptical arc or a parabolic arc. Of course, in practical designs, it may be relatively difficult to design the generatrix of the curved surface as an accurate elliptical arc or an accurate parabolic arc, so the generatrix of the curved surface may be designed as an approximate elliptical arc, an approximate parabolic arc or a stepped form as needed and degrees of accuracy may be chosen as needed. With continuous advancement of the technologies, the designing manners are also updated continuously, and there may be a better designing process for the metamaterial to achieve the refractive index distribution provided by the present invention.

Each of the man-made microstructures is a two-dimensional (2D) or three-dimensional (3D) structure consisting of a metal wire and having a geometric pattern, and may be of for example but is not limited to, a "cross" shape, a 2D snowflake shape or a 3D snowflake shape. The metal wire may be a copper wire or a silver wire, and may be attached on the substrate through etching, electroplating, drilling, photolithography, electron etching or ion etching. The plurality of man-made microstructures in the metamaterial make refractive indices of the metamaterial decrease as the angle θ increases. Given that an incident electromagnetic wave is known, by appropriately designing topology patterns of the man-made microstructures and designing arrangement of the man-made microstructures of different dimensions within an electromagnetic wave converging component, the refractive index distribution of the metamaterial can be adjusted to convert an electromagnetic wave diverging in the form of a spherical wave into a plane electromagnetic wave.

Figure 11:
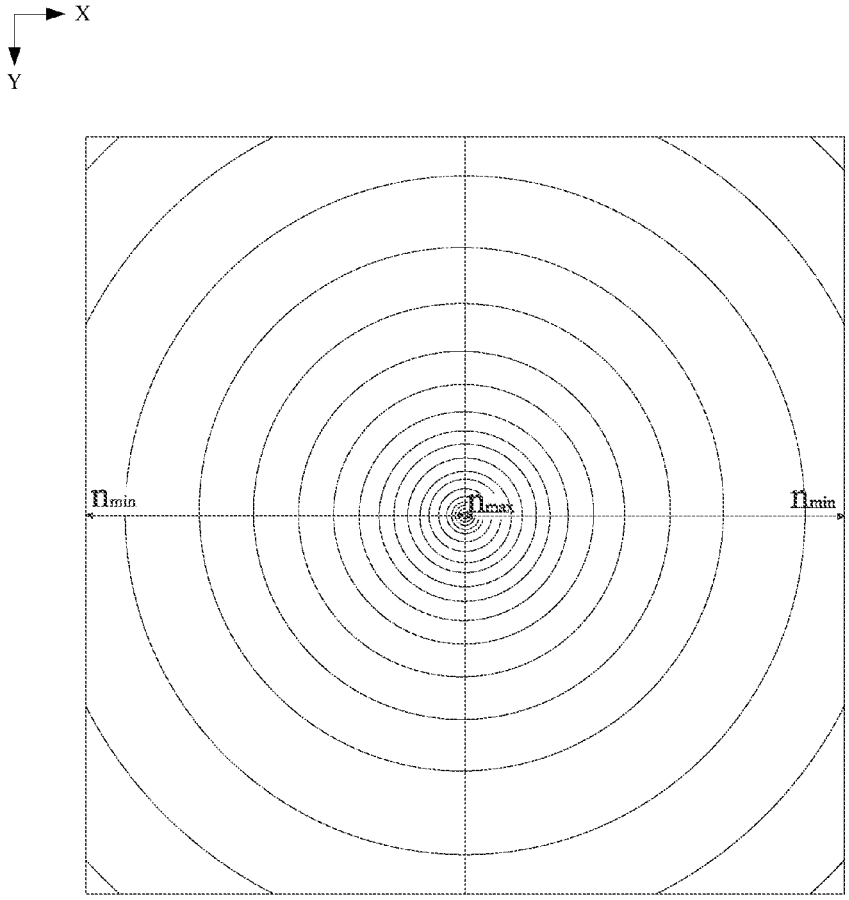
FIG. 11 is a diagram illustrating the refractive index distribution of the metamaterial of FIG. 9 in the yx plane.

In order to more intuitively represent the refractive index distribution of each of the metamaterial sheet layers in a YX plane, the units that have the same refractive index are connected to form a line, and the magnitude of the refractive index is represented by the density of the lines. A higher density of the lines represents a larger refractive index. The refractive index distribution of the metamaterial satisfying all of the above relational expressions is as shown in FIG. 11.

The present invention has been elucidated in detail by taking the parabolic arc and the elliptical arc as examples. As a non-limiting example, the present invention may further be applied to other kinds of curves such as irregular curves. The cases satisfying the refractive index distribution principle of the present invention shall all fall within the scope of the present invention.

The present invention further provides a metamaterial antenna. As shown in FIG. 2 and FIG. 3, the metamaterial antenna comprises the metamaterial 10 and a radiation source 20 disposed at a focus of the metamaterial 10. The structure and the refractive index variations of the metamaterial 10 have been described above, and thus will not be further described herein.

The aforesaid metamaterial may be in the shape shown in FIG. 3, and of course, may also be made into other desired shapes such as an annular shape so long as the aforesaid refractive index variation rules can be satisfied.

In practical applications, in order to achieve better performances of the metamaterial and reduce the reflection, an impedance matching layer may be disposed at each of two sides of the metamaterial. Details of the impedance matching layer can be found in the prior art documents, and thus will not be further described herein.

By designing abrupt transitions of the refractive indices of the metamaterial to follow a curved surface according to the present invention, the refraction, diffraction and reflection at the abrupt transition points can be significantly reduced. As a result, the problems caused by interferences are eased, which further improves performances of the metamaterial.

The embodiments of the present invention have been described above with reference to the attached drawings; however, the present invention is not limited to the aforesaid embodiments, and these embodiments are only illustrative but are not intended to limit the present invention. Those of ordinary skill in the art may further devise many other implementations according to the teachings of the present invention without departing from the spirits and the scope claimed in the claims of the present invention and all of the implementations shall fall within the scope of the present invention.

What is claimed is:

1. A metamaterial having a thickness between a first and second surface, configured such that the first and second surfaces are perpendicularly disposed to a propagation direction of plane electromagnetic waves exiting the second surface, a curved surface within the metamaterial that extends through the thickness, wherein an electromagnetic wave diverging in the form of a spherical wave is emitted from a radiation source and incident on the first surface;

a set of first straight lines connecting the radiation source to a corresponding set of points on a circular boundary line between the curved surface and the first surface of the metamaterial, and a second straight line perpendicular to the metamaterial, wherein each first straight line forms an angle θ with the second straight line, wherein the same angle θ which uniquely corresponds to each of the points in the set of points;

additional sets of first straight lines connecting the radiation source to additional corresponding sets of points along the curved surface, wherein each additional set of points on the curved surface form a circular line and has a same uniquely corresponding angle θ and a same refractive index; the curved surface has a generatrix which extends along a direction of the thickness of the man-made composite material and between the first surface and the second surface is formed by rotating the generatrix about the second straight line; and refractive indices of the metamaterial decrease gradually as the angle θ increases.

2. The metamaterial of claim 1, wherein the refractive index distribution of the curved surface satisfies:

$$n(\theta) = \frac{1}{S(\theta)}\left[F\left(1 - \frac{1}{\cos\theta}\right) + n_{max}d\right];$$

where, S(θ) is an arc length of a generatrix of the curved surface, F is a distance from the radiation source to the metamaterial; d is a thickness of the metamaterial; and $n_{max}$ is the maximum refractive index of the metamaterial.

3. The metamaterial of claim 2, wherein the metamaterial comprises at least one metamaterial sheet layer, each of which comprises a sheet-like substrate and a plurality of man-made microstructures attached on the substrate.

4. The metamaterial of claim 3, wherein each of the man-made microstructures is a two-dimensional (2D) or three-dimensional (3D) structure having a geometric pattern.

5. The metamaterial of claim 4, wherein each of the man-made microstructures is of a "cross" shape or a snowflake shape.

6. The metamaterial of claim 2, wherein when the generatrix of the curved surface is a parabolic arc, the arc length S(θ) of the parabolic arc satisfies:

$$S(\theta) = \frac{d}{2}\left[\frac{\log\left(|\tan\theta| + \sqrt{1+\tan^2\theta}\right) + \delta}{|\tan\theta| + \delta} + \sqrt{1+\tan^2\theta}\right];$$

where θ is a preset decimal.

7. The metamaterial of any of claim 6, wherein when a line passing through a center of the first surface of the metamaterial and perpendicular to the metamaterial is taken as an abscissa axis and a line passing through the center of the first surface of the metamaterial and parallel to the first surface is taken as an ordinate axis, an equation of a parabola where the parabolic arc is located is represented as:

$$y(x) = \tan\theta\left(-\frac{1}{2d}x^2 + x + F\right).$$

8. The metamaterial of claim 7, wherein the angle θ and each point (x, y) of the parabolic arc satisfy the following relational expression:

$$\theta(x, y) = \tan^{-1}\left[\frac{2dy}{2d(F+x) - x^2}\right].$$

9. The metamaterial of claim 2, wherein when the generatrix of the curved surface is an elliptical arc, the line passing through the center of the first surface of the metamaterial and perpendicular to the metamaterial is taken as an abscissa axis and the line passing through the center of the first surface of the metamaterial and parallel to the first surface is taken as an ordinate axis, an equation of an ellipse where the elliptical arc is located is represented as:

$$\frac{(x-d)^2}{a^2} + \frac{(y-c)^2}{b^2} = 1;$$

where a, b and c satisfy the following relationships:

$$\frac{d^2}{a^2} + \frac{(F\tan\theta - c)^2}{b^2} = 1;$$

$$\frac{\sin\theta}{\sqrt{n^2(\theta) - \sin^2(\theta)}} = \frac{b^2}{a^2}\frac{d}{F\tan\theta - c}.$$

10. The metamaterial of claim 9, wherein a center of the ellipse where the elliptical arc is located is located on the second surface and has coordinates (d, c).

11. The metamaterial of claim 9, wherein a point on the first surface corresponding to the angle θ has a refraction angle θ', and a refractive index n(θ) of the point satisfies:

$$n(\theta) = \frac{\sin\theta}{\sin\theta'}.$$

12. The metamaterial of claim 1, wherein when the generatrix of the curved surface is a circular arc, the refractive index distribution of the curved surface satisfies:

$$n(\theta) = \frac{\sin\theta}{d\times\theta}\left(n_{max}\times d + s - \frac{s}{\cos\theta}\right);$$

where, s is a distance from the radiation source to the metamaterial; d is a thickness of the metamaterial; and $n_{max}$ is the maximum refractive index of the metamaterial.

13. The metamaterial of claim 12, wherein a perpendicular line of a line connecting the radiation source to a point on the first surface of the metamaterial intersects with the second surface of the metamaterial at a circle center of the circular arc, and a perpendicular line segment between the circle center and a point on the first surface of the metamaterial is a radius of the circular arc.

14. The metamaterial of claim 12, wherein the metamaterial is provided with an impedance matching layer at two sides thereof respectively.

15. A metamaterial antenna having a thickness between a first and second surface, comprising a metamaterial and a radiation source, configured such that the first and second surfaces are perpendicularly disposed to a propagation direction of plane electromagnetic waves exiting the second surface, a curved surface within the metamaterial that extends through the thickness, wherein an electromagnetic wave diverging in the form of a spherical wave is emitted from the radiation source and incident on the first surface;

a set of first straight lines connecting the radiation source to a corresponding set of points on a circular boundary line between the curved surface and the first surface of the metamaterial, and a second straight line perpendicular to surface of the metamaterial, wherein each first straight line forms an angle θ with the second straight line, wherein the same angle θ corresponds to each of the points in the set of points;

additional sets of first straight lines connecting the radiation source to additional corresponding sets of points along the curved surface, wherein each additional set of points on the curved surface form a circular line and has a same uniquely corresponding angle θ and a same refractive index; the curved surface has a generatrix which extends along a direction of the thickness of the man-made composite material and between the first surface and the second surface is formed by rotating the generatrix about the second straight line; and refractive indices of the metamaterial decrease gradually as the angle θ increases.

16. The metamaterial antenna of claim 15, wherein the refractive index distribution of the curved surface satisfies:

$$n(\theta) = \frac{1}{S(\theta)}\left[F\left(1 - \frac{1}{\cos\theta}\right) + n_{max}d\right];$$

where, S(θ) is an arc length of a generatrix of the curved surface, F is a distance from the radiation source to the metamaterial; d is a thickness of the metamaterial; and $n_{max}$ is the maximum refractive index of the metamaterial.

17. The metamaterial antenna of claim 16, wherein the metamaterial comprises at least one metamaterial sheet layer, each of which comprises a sheet-like substrate and a plurality of man-made microstructures attached on the substrate.

18. The metamaterial antenna of claim 16, wherein when the generatrix of the curved surface is an elliptical arc, a line passing through a center of the first surface of the metamaterial and perpendicular to the metamaterial is taken as an abscissa axis and a line passing through the center of the first surface of the metamaterial and parallel to the first surface is taken as an ordinate axis, an equation of an ellipse where the elliptical arc is located is represented as:

$$\frac{(x-d)^2}{a^2} + \frac{(y-c)^2}{b^2} = 1;$$

where a, b and c satisfy the following relationships:

$$\frac{d^2}{a^2} + \frac{(F\tan\theta - c)^2}{b^2} = 1;$$

$$\frac{\sin\theta}{\sqrt{n^2(\theta) - \sin^2(\theta)}} = \frac{b^2}{a^2}\frac{d}{F\tan\theta - c}.$$

19. The metamaterial antenna of claim 16, wherein when the generatrix of the curved surface is a parabolic arc, the arc length S(θ) of the parabolic arc satisfies:

$$S(\theta) = \frac{d}{2}\left[\frac{\log\left(|\tan\theta| + \sqrt{1+\tan^2\theta}\right) + \delta}{|\tan\theta| + \delta} + \sqrt{1+\tan^2\theta}\right];$$

where θ is a preset decimal.

20. The metamaterial antenna of claim 19, wherein when the line passing through the center of the first surface of the metamaterial and perpendicular to the metamaterial is taken as an abscissa axis and the line passing through the center of the first surface of the metamaterial and parallel to the first surface is taken as an ordinate axis, an equation of a parabola where the parabolic arc is located is represented as:

$$y(x) = \tan\theta\left(-\frac{1}{2d}x^2 + x + F\right).$$

* * * * *